US005746588A

United States Patent [19]

Binzer

[11] Patent Number: 5,746,588

[45] Date of Patent: May 5, 1998

[54] DUAL INLET GAS BURNER

[76] Inventor: Dan Binzer, 13120 76th Avenue, Surrey, British Coumbia, Canada, V3W 2V6

[21] Appl. No.: 609,355

[22] Filed: Mar. 1, 1996

[51] Int. Cl.[6] ..... F23D 14/10

[52] U.S. Cl. ..... 431/354; 431/12; 431/328; 126/512

[58] Field of Search ..... 431/354, 328, 431/12; 126/512, 41 R

[56] References Cited

U.S. PATENT DOCUMENTS

| | | | |
|---|---|---|---|
| 387,666 | 8/1888 | Van Wie . | |
| 585,631 | 6/1897 | Langwith . | |
| 1,103,992 | 7/1914 | Murray . | |
| 1,420,277 | 6/1922 | Packer | 431/354 |
| 1,517,394 | 12/1924 | Bengston | 431/354 |
| 1,618,024 | 2/1927 | Roberts | 431/354 |
| 2,315,547 | 4/1943 | Ryan | 431/354 |
| 3,824,984 | 7/1974 | Swanson et al. . | |
| 4,610,627 | 9/1986 | Wise | 431/354 |
| 5,554,022 | 9/1996 | Nabors, Jr. et al. | 431/252 |

*Primary Examiner*—Carl D. Price
*Attorney, Agent, or Firm*—Galgano & Burke

[57] ABSTRACT

A burner for a gas fireplace wherein a plurality of apertures are provided along the length of an enclosure and gas inlets are provided for introducing gas into both ends of the enclosure. Movable members are disposed over air inlet holes at each end for selectively restricting the inlet of combustion air into the enclosure thereby allowing control over the longitudinal position of maximum flame from the burner.

6 Claims, 4 Drawing Sheets

DUAL INLET GAS BURNER

TECHNICAL FIELD OF THE INVENTION

This invention relates to a burner for gas fireplaces.

BACKGROUND OF THE INVENTION

A typical prior art burner for a gas burning fireplace consists of an elongated and usually cylindrical enclosure having several apertures extending the longitudinal length of the enclosure. Gas is introduced to the enclosure by a gas inlet at one end of the enclosure and means are provided, usually by apertures in the inlet pipe, for mixing air with the gas. The gas accumulates in the enclosure and exits through the apertures where it is ignited. In such prior art burners, the gas pressure tends to build up at the end of the enclosure distal from the gas inlet which would result in a flame concentrated at the distal end. The prior art addresses this problem by including one or more baffles within the enclosure to provide an even distribution of pressure of the gas and therefore a more uniform distribution of flame along the longitudinal length of the enclosure. As a result of the need for such baffles, the enclosure is relatively bulky, a disadvantage when there is limited space available in which to install or service the burner.

It is an object of this invention to provide a smaller burner which does not require internal baffles, but which nonetheless offers the possibility of an evenly distributed flame along the longitudinal length of the burner enclosure.

It is a further object of the invention to provide means for controlling the longitudinal position of maximum flame of the burner thereby accommodating user preferences in the presentation of the flame.

SUMMARY OF THE INVENTION

In one of its aspects, the invention comprises a burner for a gas fireplace having an elongated and mostly hollow enclosure, with at least two ends, a plurality of apertures substantially along the length of the enclosure, and gas inlets for introducing gas into each end of the enclosure.

In another, more particular aspect, the invention comprises a burner for a gas fireplace having an elongated and mostly hollow enclosure with at least two ends, a plurality of apertures substantially along the length of the enclosure, and gas inlets for introducing gas into each end of the enclosure. Air inlet holes are provided at each end of the enclosure. A movable member is provided on each end of the enclosure in the vicinity of the air inlet holes. The members are adapted to restrict the flow of the air through the air inlet holes to a varying degree according to the position of the movable member.

In yet another aspect, the invention comprises a burner for a gas fireplace having an elongated and mostly hollow enclosure with at least two ends, a plurality of apertures substantially along the length of the enclosure, and gas inlets for introducing gas into each end of the enclosure. Air inlet holes are provided at each end of the enclosure. A movable member is provided on each end of the enclosure near the air inlet holes. The members are adapted to restrict the flow of the air through the air inlet holes to a varying degree according to the position of the movable member. An electronic controller is provided for selectively controlling the movement of the members over the air inlet holes and there are means for actuating the simultaneous movement the members.

DETAILED DESCRIPTION OF THE PREFERRED EMBODIMENT

The invention may be more fully appreciated by reference to the preferred embodiment described below in conjunction with the drawings in which.

Figure 1:
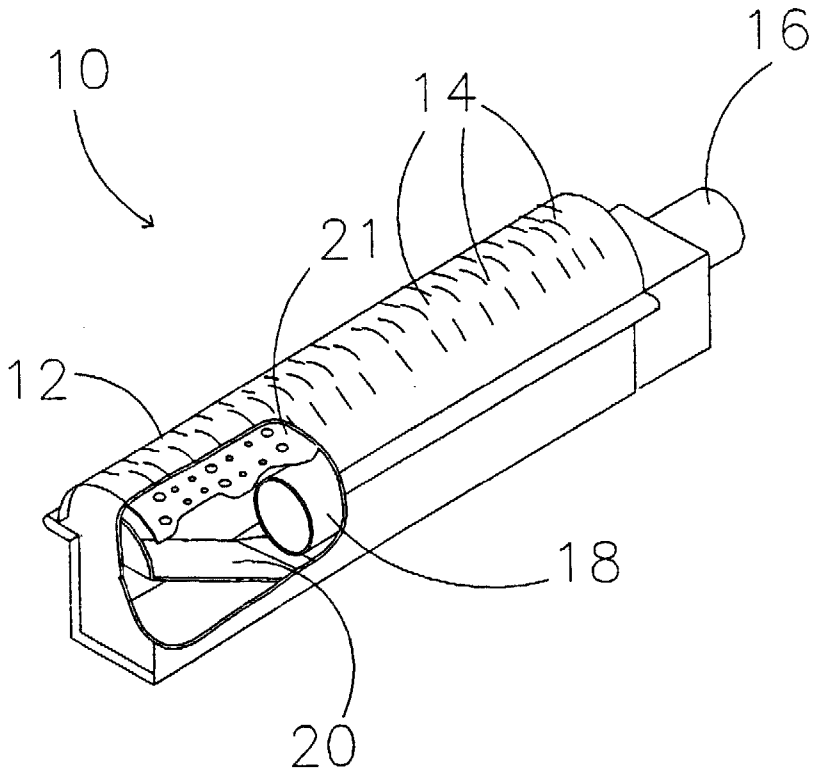
Fig 1 (prior art)
FIG. 1 is a perspective partially cut-away view of a typical prior art burner.

Referring to FIG. 1, there is illustrated a typical prior art burner 10. The prior art burner 10 includes a generally elongated and partly cylindrical enclosure 12 having a plurality of apertures 14 along its length. A gas inlet 16 is provided at one end of the enclosure 12 for providing gas to gas chamber 18. Air inlet apertures (not shown) are provided at the inlet 16 to allow the mixing of air with the gas to enable combustion. Gas chamber 18 directs the gas-air mix to a ramp 20 which directs the mix along the baffle 21.

Baffle 21 distributes the gas pressure evenly along the longitudinal length of the enclosure prior to the gas exiting the enclosure by apertures 14.

Figure 2:
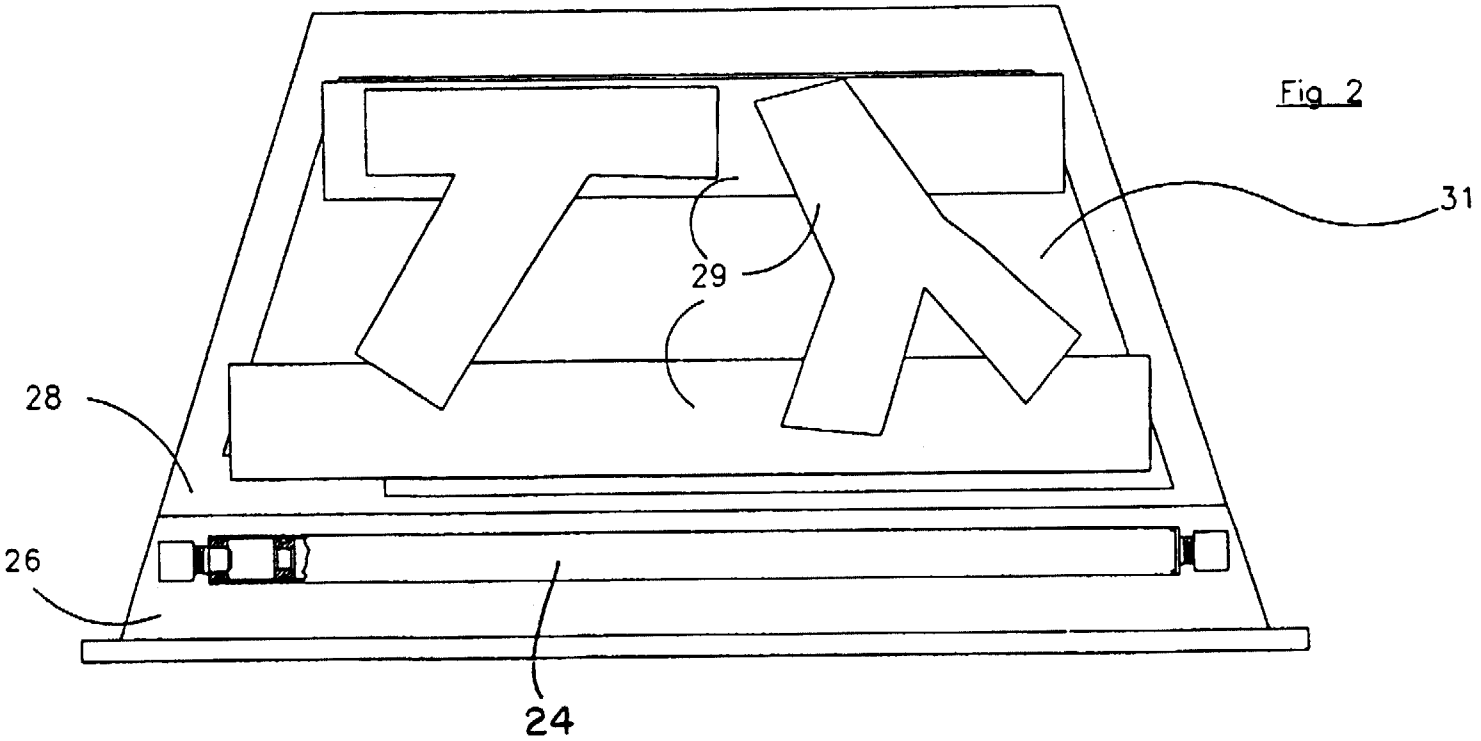
FIG. 2 is a front view of a burner according to the invention, shown as it would appear in relation to the lower and upper pan bases of a gas fireplace.

FIG. 2 illustrates a burner according to the invention in relation to certain elements of a gas fireplace in which it would be installed. The gas burner 24 is located between the lower pan base 26 and the upper pan base 28 of the fireplace. A log set 29 is also illustrated in FIG. 2 as resting on a fibre ramp 31. It will be appreciated by those skilled in the art that the vertical clearance between the lower pan base 26 and the upper pan base 28 is relatively small in certain fireplace configurations, such as for example gas fireplace inserts.

Figure 3:
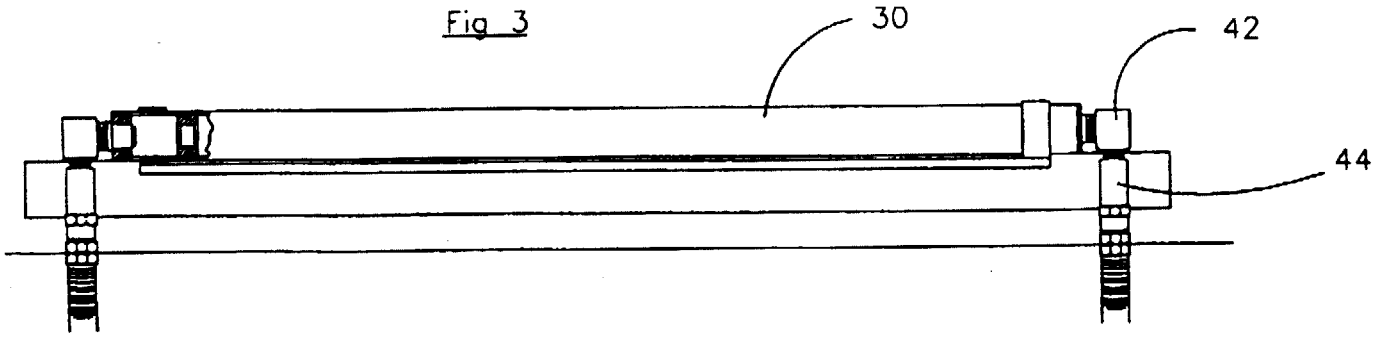
FIG. 3 is a front view of the burner according to the invention, including the gas fittings on both ends of the burner.
Figure 4:
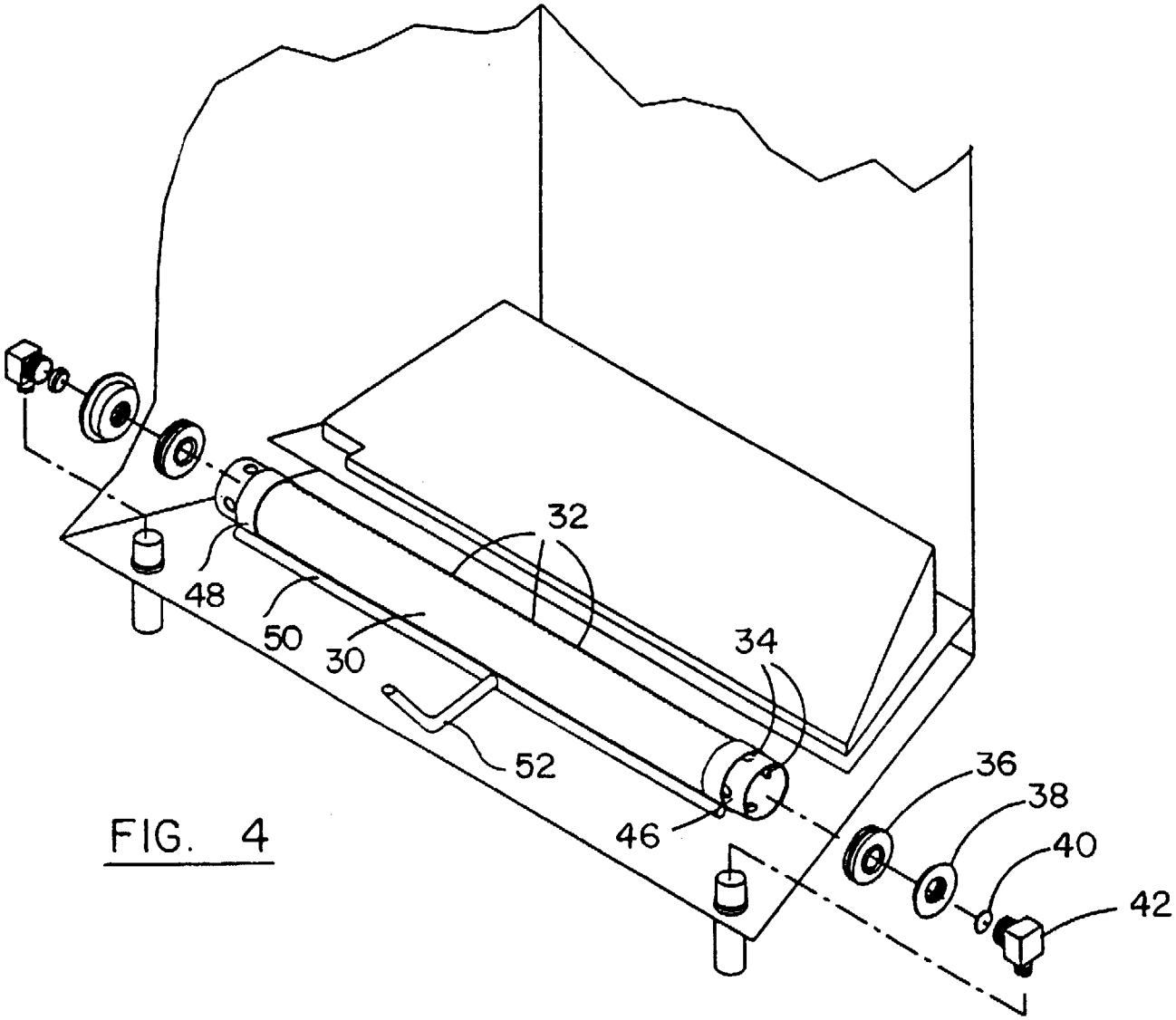
FIG. 4 is an isometric view of the burner according to the invention and associated components.

FIGS. 3 and 4 illustrate a gas burner according to the invention. The burner includes a mostly hollow cylindrical enclosure 30 provided with a plurality of longitudinally aligned apertures 32 substantially along the length of the enclosure 30. Four air inlet apertures 34 are evenly spaced around each end of the enclosure 30.

Inline venturi 36, gas inlet 38 and orifice 40 are terminations provided at each end of enclosure 30 for introducing gas into the enclosure. An elbow 42 is provided to establish a connection between the terminations 36, 38 and 40 and a gas fitting 44. The introduction of gas at both ends of enclosure 30 provides for an even distribution of gas pressure along the length of the enclosure without the need for any internal baffle structure, thereby allowing the enclosure 30 to be smaller than enclosures according to the prior art. The invention thereby achieves a longitudinally even distribution of flame with a smaller burner enclosure than was possible in prior art structures.

Figure 5:
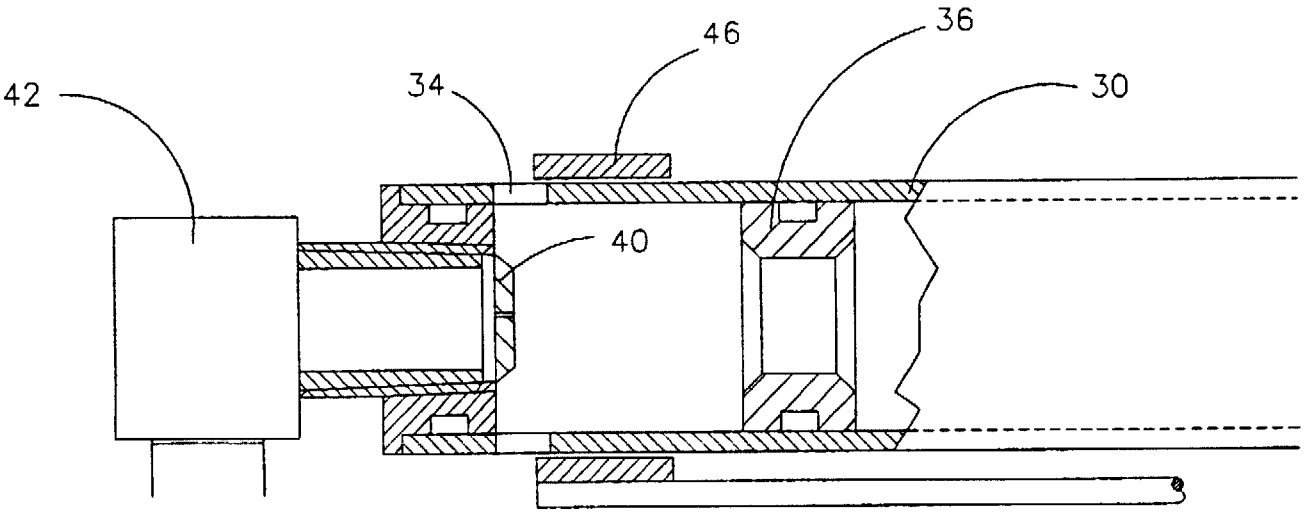
FIG. 5 is a cross-sectional view of one end of the burner according to the invention, including an air damper.

Referring now to FIGS. 4 and 5, a movable member 46 is provided over the enclosure in the vicinity of the air inlets 34. In the preferred embodiment member 46 is a sleeve encircling the enclosure. The sleeve may be adjusted by sliding along the enclosure 30 to partially cover the air inlets 34. This acts as an air damper and so as to restrict the amount of air entering the enclosure and to thereby restrict the amount of air available for combustion. Restricting the air available for combustion at one end of the enclosure has the result of creating a pressure differential inside the enclosure thus causing the bulk of the flame to move towards the restricted air inlet. It will therefore be appreciated that the use of an adjustable air damper over the air inlet enables the positioning of the maximum height of the flame as well as the positioning of the absence of a flame along the longitudinal length of the enclosure. It will further be appreciated that the provision of air damper sleeves at both ends of the enclosure enables the installer or user to achieve greater flexibility in the longitudinal positioning of the flame than by the use of a single air damper at one end of the enclosure.

As illustrated in FIG. 4, the sleeves 46, 48 at each end of enclosure 30 are connected by an actuator shaft 50 on which is mounted a handle 52. This arrangement allows the simultaneous and complementary sliding of sleeves at both ends of the enclosure so as to adjust the position of the flame in the fireplace. The sleeve may also be adjusted to restrict the air inlet at the time of installation in which case the sleeve may be secured into position. Alternatively, it is within the scope of the invention to provide similar sleeves at both ends of the enclosure which are capable of being controlled electro-mechanically between a position in which the air inlets are not restricted and the position in which the air inlets are partially restricted. The control of the sleeve may be by means of an electronic controller providing actuation signals to the electro-mechanical apparatus controlling each of the sleeves. Such controller could be set by the user of the fireplace or by an installer or manufacturer of the burner to provide a programmed or random movement of the flame along the longitudinal length of the enclosure.

It should be noted that the means for restricting the air inlets at one or both ends of the enclosure need not necessarily be cylindrical sleeves but may be any convenient means of restricting the air inlet, and the enclosure is preferably, but not necessarily cylindrical in shape, all within the scope of the invention. It will be appreciated by those skilled in the art that other variations on the details of the preferred embodiment may be practised without departing from the scope of the invention.

What is claimed is:

1. A substantially elongated gas fireplace burner, said burner comprising a substantially hollow enclosure comprising:

at least one gas inlet;

at least one air inlet;

at least two apertures which vent a gas and air mixture from a first position and a second position, respectively, on the burner;

means for selectively moving a maximum flame emanating from the burner enclosure between said first position and said second position; and at least two venturis disposed between said air inlet and said two apertures which vent a gas and air mixture, and wherein said moving means is adapted to restrict the flow of air through the air inlet to a varying degree according to the position of the moving means.

2. A substantially elongated gas fireplace burner, said burner comprising a substantially hollow enclosure comprising:

at least one gas inlet;

at least one air inlet;

at least two apertures which vent a gas and air mixture from a first position and a second position, respectively, on the burner;

means for selectively moving a maximum flame emanating from the burner enclosure between said first position and said second position;

said enclosure comprising two longitudinal ends and a first set of air inlet holes grouped at one of said longitudinal ends and a second set of air inlet holes grouped at the other of said longitudinal ends;

wherein said moving means comprises a movable member at each end of the enclosure, each such movable member being adapted to restrict the flow of air through the air inlet holes to a varying degree according to the position of the movable member; and wherein the movable members are adapted for simultaneous movement in relation to the air inlet holes at their respective ends of the enclosure.

3. A burner for a gas fireplace comprising an elongated and mostly hollow enclosure extending between two longitudinal ends of said enclosure, gas inlets for introducing gas axially into each longitudinal end of the enclosure, a plurality of apertures substantially along the length of the enclosure for venting a gas and air mixture from said enclosure;

a first set of air inlet holes grouped at one of said longitudinal ends and a second set of air inlet holes grouped at the other of said longitudinal ends;

a movable member adapted to restrict the flow of air through the air inlet holes at each end of the enclosure, wherein the movable members at each end of the enclosure are adapted for simultaneous movement in relation to the air inlet holes at their respective ends of the enclosure such that as one of said movable members moves in a direction to further restrict the flow of air through its corresponding air inlet, the other of said movable members moves to allow an increased flow of air through its corresponding air inlet.

4. A substantially elongated gas fireplace burner, said burner comprising a substantially hollow enclosure comprising:

at least one gas inlet;

at least one air inlet;

at least two apertures which vent a gas and air mixture from a first position and a second position, respectively, on the burner;

means for selectively moving a maximum flame emanating from the burner enclosure between said first position and said second position; and at least two venturis disposed between said air inlet and said two apertures which vent a gas and air mixture.

5. A substantially elongated gas fireplace burner comprising an elongated and mostly hollow enclosure extending between two longitudinal ends of said enclosure, at least one gas inlet for introducing gas axially into said enclosure, a plurality of apertures substantially along the length of the enclosure which vent a gas and air mixture from said enclosure;

a first set of air inlet holes grouped at one of said longitudinal ends and a second set of air inlet holes grouped at the other of said longitudinal ends;

at least one movable member adapted to selectively restrict the flow of air through said first set and said second set of air inlet holes; and at least two venturis disposed between said set of air inlet holes and said venting apertures.

6. A substantially elongated gas fireplace burner comprising an elongated and mostly hollow enclosure extending between two longitudinal ends of said enclosure, at least one gas inlet for introducing gas axially into said enclosure, a plurality of apertures substantially along the length of the enclosure which vent a gas and air mixture from said enclosure;

a first set of air inlet holes grouped at one of said longitudinal ends and a second set of air inlet holes grouped at the other of said longitudinal ends, said enclosure comprising a central portion which does not include air inlet holes; and at least two venturis disposed between said air inlet holes and said venting apertures.

* * * * *